US006257950B1

(12) United States Patent
Saleh

(10) Patent No.: US 6,257,950 B1
(45) Date of Patent: Jul. 10, 2001

(54) SELF-PROPELLED TOY

(76) Inventor: Jamal M. Saleh, 14222 Kimberley #449, Houston, TX (US) 77079

( * ) Notice: Subject to any disclaimer, the term of this patent is extended or adjusted under 35 U.S.C. 154(b) by 0 days.

(21) Appl. No.: 09/569,405

(22) Filed: May 12, 2000

(51) Int. Cl.[7] ..... A63H 7/00; A63H 11/00; A63H 3/36

(52) U.S. Cl. ..... 446/356; 446/352; 446/377; 446/390

(58) Field of Search ..... 446/236, 330, 446/352, 353, 354, 355, 356, 377, 316, 307, 309, 311, 390

(56) References Cited

U.S. PATENT DOCUMENTS 1,605,307 11/1926 Walker .
1,762,574 6/1930 Fox .
3,744,182 7/1973 Terzian et al. .
4,218,844 * 8/1980 Knibbs .
4,795,395 * 1/1989 Oishi et al. ..... 446/175
5,713,780 2/1998 Gallagher .
6,095,887 * 8/2000 Llorens ..... 446/355

* cited by examiner

*Primary Examiner*—D. Neal Muir
(74) *Attorney, Agent, or Firm*—Henderson & Sturm LLP

(57) ABSTRACT

A self-propelled toy including a body member in the shape of an animal such as a gorilla. The body member includes a torso with a pair of legs and a pair of rotatably attached arms that are slightly longer than the legs when rotated to their lowermost position. A rotary drive, such as a battery powered DC motor or a wound spring drive, is operably attached to the body member with its output drivably coupled to the arms. The arms rotate 360° with respect to the torso in synchronization with each other. Pivotally connected hand and feet portions provide a degree of freedom for better landing and balance. As the arms rotate, the hands contact the floor to raise the body member and move it a step forward. Each complete revolution of the arms advances the toy another step forward.

14 Claims, 1 Drawing Sheet

SELF-PROPELLED TOY

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of toys, and more particularly to a self-propelled toy.

2. Description of Related Art

As can be seen by reference to the following U.S. Pat. Nos. 1,605,307; 1,762,574; 3,744,182 and 5,713,780 the prior art is replete with myriad and diverse self-propelled toys.

While all of the aforementioned prior art constructions are more than adequate for the basic purpose and function for which they have been specifically designed, they are uniformly deficient with respect to their failure to provide a simple, efficient, and practical self-propelled toy.

As a consequence of the foregoing situation, there has existed a longstanding need for a new and improved self-propelled toy and the provision of such a construction is a stated objective of the present invention.

BRIEF SUMMARY OF THE INVENTION

Briefly stated, the present invention provides a self-propelled toy including a body member in the shape of an animal such as a gorilla. The body member includes a torso with a pair of legs and a pair of rotatably attached arms that are slightly longer than the legs when rotated to their lowermost position. A rotary drive, such as a battery powered DC motor or a wound spring drive, is operably attached to the body member with its output drivably coupled to the arms. The arms rotate 360° with respect to the torso in synchronization with each other. Pivotally connected hand and feet portions provide a degree of freedom for better landing and balance. As the arms rotate, the hands contact the floor to raise the body member and move it a step forward. Each complete revolution of the arms advances the toy another step forward.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
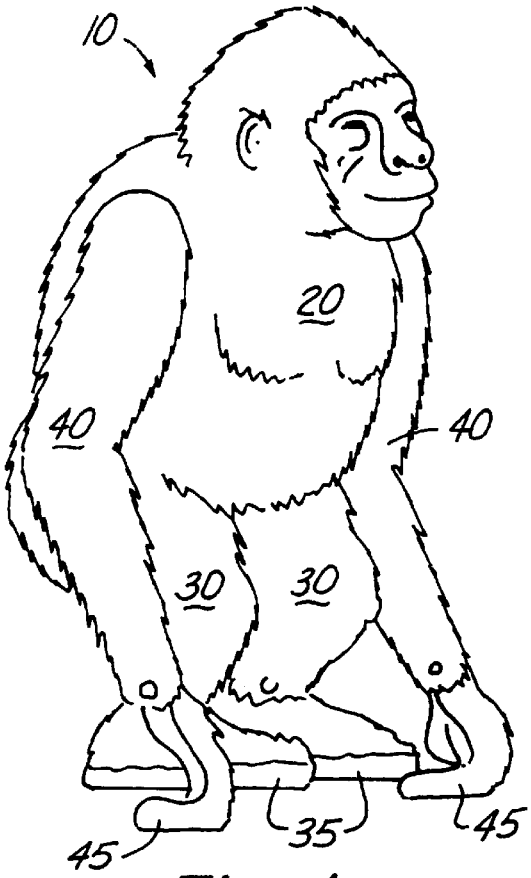
FIG. 1 is a perspective view of the self-propelled toy of the present invention formed in the shape of a gorilla.
Figure 2:
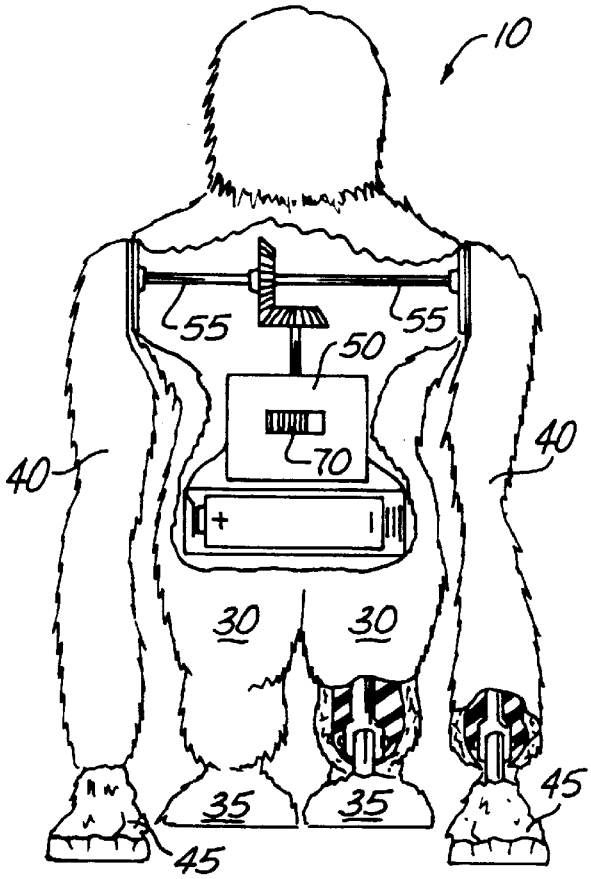
FIG. 2 is a rear elevational view of the toy with portions cut away to show the battery powered DC motor drive, and the pivotal connection of the hands and feet.

As can be seen by reference to the drawings, and in particularly to FIG. 1, the self-propelled toy that forms the basis of the present invention is designated generally by the reference number 10. The toy 10 includes a body member with a torso 20, legs 30, and rotatably attached arms 40, which are slightly longer than the legs 30 when the arms 40 are rotated to their lowermost position. The legs 30 have pivotally connected feet 35 and the arms 40 have pivotally connected hands 45. A battery powered DC motor 50 is carried within the torso 20, and rotary output shafts 55 are connected to and rotate the arms 40.

Although the drawings illustrate the toy 10 in the shape of a gorilla, it is to be understood that it could take the shape of any human or animal figure. Also, it is to be understood that the rotary drive could be a wound spring or other suitable drive that provides a rotary output.

Figure 3:
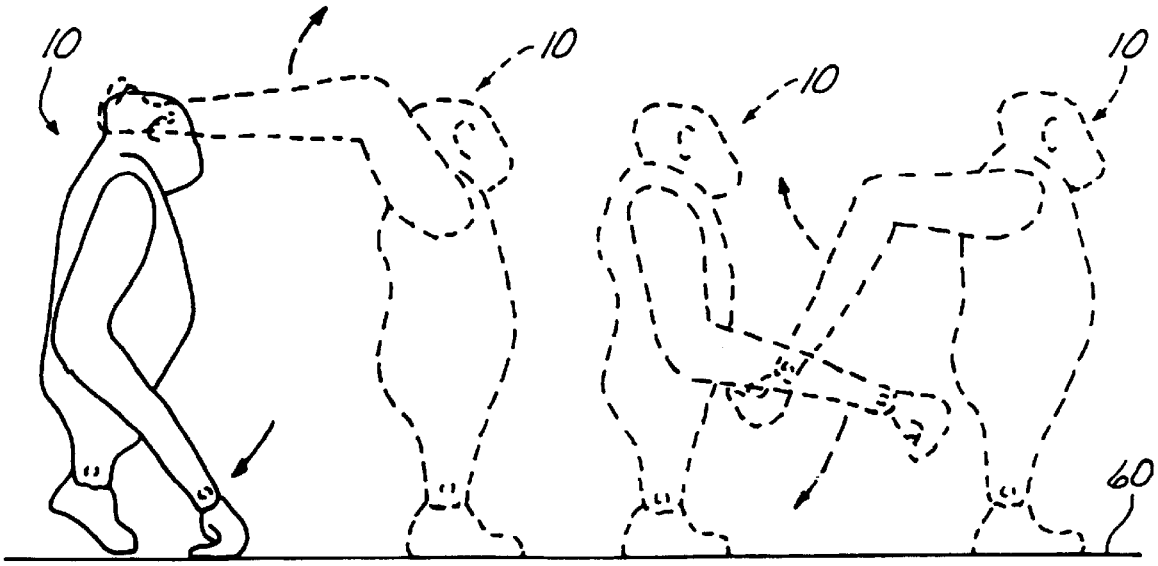
FIG. 3 is a side elevational view of the toy with a dashed line showing of the rotation of the arms to provide forward movement.

In use, the toy 10 is placed on a surface 60 such as a floor or table and the motor 50 is activated by the switch 70. The arms 40 then rotate 360° with respect to the torso 20 as illustrated in FIG. 3. The arms 40 are in synchronization with each other so that the hands 45 contact the surface 60 at approximately the same time. This raises the toy 10 and moves it a step forward. Each successive rotation of the arms 40 advances the toy 10 another step forward.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A self-propelled toy, comprising:

a body member including a torso having a lower portion and an upper portion, a pair of legs depending down from the lower portion of the torso, and a pair of arms rotatably attached to the upper portion of the torso at opposite lateral sides thereof, wherein the arms extend beyond the legs when the arms are in their lowermost position; and a rotary drive operably attached to the body member and including a rotary output drivably coupled to the arms, wherein the arms are driven to rotate 360° in synchronization with each other to intermittently engage that surface the toy is placed upon to effect propulsion.

2. The self-propelled toy of claim 1 wherein the rotary drive is a battery powered electric motor.

3. The self-propelled toy of claim 1 wherein the body member is formed in the shape of an animal.

4. The shelf-propelled toy of claim 3 wherein the animal is a gorilla.

5. A self-propelled toy, comprising:

a body member including a torso having a lower portion and an upper portion, a pair of legs depending down from the lower portion of the torso, and a pair of arms rotatably attached to the upper portion of the torso at opposite lateral sides thereof, wherein the arms extend beyond the legs when the arms are in their lowermost position;

a rotary drive operably attached to the body member and including a rotary output drivably coupled to the arms, wherein the arms rotate 360° in synchronization with each other; and wherein the arms include pivotally connected hand portions.

6. The self-propelled toy of claim 5 wherein the legs include pivotally connected feet portions.

7. The self-propelled toy of claim 5 wherein the rotary drive is a battery powered electric motor.

8. The self-propelled toy of claim 5 wherein the body member is formed in the shape of an animal.

9. The shelf-propelled toy of claim 8 wherein the animal is a gorilla.

10. A self-propelled toy, comprising:

a body member including a torso having a lower portion and an upper portion, a pair of legs depending down from the lower portion of the torso, and a pair of arms rotatably attached to the upper portion of the torso at opposite lateral sides thereof, wherein the arms extend beyond the legs when the arms are in their lowermost position;

a rotary drive operably attached to the body member and including a rotary output drivably coupled to the arms, wherein the arms rotate 360° in synchronization with each other; and wherein the legs include pivotally connected feet portions.

11. The self-propelled toy of claim 10 wherein the arms include pivotally connected hand portions.

12. The self-propelled toy of claim 10 wherein the rotary drive is a battery powered electric motor.

13. The self-propelled toy of claim 10 wherein the body member is formed in the shape of an animal.

14. The shelf-propelled toy of claim 13 wherein the animal is a gorilla.

* * * * *